United States Patent [19]

Millerioux

[11] 4,063,566

[45] Dec. 20, 1977

[54] TENT WITH PORTABLE DISASSEMBLABLE MODULAR ELEMENTS

[76] Inventor: Bruno Millerioux, 71 rue Montorgueil, Paris, France, 75002

[21] Appl. No.: 667,562

[22] Filed: Mar. 17, 1976

[30] Foreign Application Priority Data

| | | |
|---|---|---|
| Sept. 26, 1974 | France | 74.32393 |
| Dec. 22, 1975 | France | 75.39327 |

[51] Int. Cl.[2] ..... A45F 1/00; E04B 1/347

[52] U.S. Cl. ..... 135/1 R; 135/3 E; 135/8; D88/3 B

[58] Field of Search ..... 135/1 R, 3 E, 8; D88/3 B

[56] References Cited

U.S. PATENT DOCUMENTS

| | | | |
|---|---|---|---|
| 2,263,867 | 11/1941 | Barnard | 135/1 R |
| 3,397,710 | 8/1968 | McElroy | 135/1 R |
| 3,699,986 | 10/1972 | Kirkham | 135/1 R |
| 3,874,396 | 4/1975 | Kirkham | 135/1 R |

FOREIGN PATENT DOCUMENTS

| | | | |
|---|---|---|---|
| 1,049,850 | 8/1953 | France | 135/1 R |
| 460,315 | 7/1968 | Switzerland | 135/1 R |

*Primary Examiner*—Werner H. Schroeder

*Assistant Examiner*—Conrad L. Berman

*Attorney, Agent, or Firm*—Burgess, Ryan and Wayne

[57] ABSTRACT

This invention is related to a tent constituted by portable elements adapted to be manually assembled and disassembled, said tent comprising a plurality of modules having substantially identical respective volumes and shapes, each module being constituted by at least one fabric panel and said modules being assembled by sewing or similar means, each module being supported by supporting means resting on the ground, said modules comprising each two lateral wall portions and a substantially triangular end wall portion, said two lateral wall portions having a common top edge, two rising end edges connected each to a rising edge of the end wall portion as well as two inner rising edges connected each to the rising inner edge of the adjacent lateral wall portion of the adjacent module, said modules being adapted to be supported each by said supporting means at an outer top point defined by the intersection of said rising edges of the associated end wall portion and said edge of the module in question, while each module is anchored to the ground by anchoring means known per se, each anchoring means being connected to a respective end of said rising edges.

21 Claims, 10 Drawing Figures

TENT WITH PORTABLE DISASSEMBLABLE MODULAR ELEMENTS

SUMMARY OF THE INVENTION

The instant invention is related to a tent, especially to a tent adapted to be used for camping.

The invention is concerned more particularly to a tent constituted by a plurality of modules each one of which comprises at least one panel of fabric, said modules being assembled by sewing or similar means and each module being supported by holding means which rest on the ground.

The present invention is intended to provide a tent of the kind indicated herein above, which, as compared to known tents, has an improved habitability due to an increased volume of the tent when it is erected, said tent having furthermore a reduced weight, a more simple structure and nevertheless a perfect stability, while the cost of the tent is comparatively low, due to the fact that the said tent can be manufactured very easily.

It is an object of the instant invention to provide a tent constituted by portable elements adapted to be manually assembled and disassembled and comprising a plurality of modules including each at least one fabric panel defining two lateral wall portions and an end wall portion having a substantially triangular shape, said two lateral wall portions having a common top edge, two rising end wall edges connected each to a rising edge of the associated end wall portion, and two respective inner rising edges connected each to the inner rising edge of the adjacent lateral wall portion of an adjacent module, said modules being adapted to be supported each by said holding means at an upper point defined by the intersection of said rising edges of the end wall portion and the top edge of each module, and each module being anchored to the ground by anchoring means known per se, said anchoring means being fixed, respectively, to the lower ends of said rising edges.

Due to these novel features, the tent according to the invention is spacious, easy to erect and its cost it low; said tent can be manufactured in a most economic way on a mass-production scale, as it comprises a plurality of identical elements which can easily be assembled.

In one embodiment of the invention, each module is constituted by three assembled fabric panels each one of which constitutes one of the above mentioned wall portions, respectively, of the module.

In another embodiment, each module is constituted by two panels each one of which is formed of one of the lateral wall portions of the module in question, and of one half of the panel constituting the associated end wall portion.

In still another embodiment of the invention, each module is constituted by two fabric panels one of which defines the two lateral wall portions of the module, while the other panel defines the associated end wall portion.

The invention will be described herein below with reference to the appended drawings which show various embodiments thereof by way of example, but not of limitation.

Figure 4:
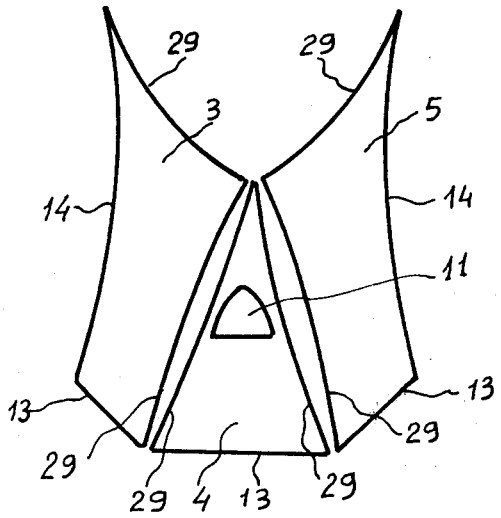

FIG. 4 schematically shows an embodiment of the tent according to the invention, comprising three flat fabric elements, prior to assembly with a view to forming a module.

Figure 5:
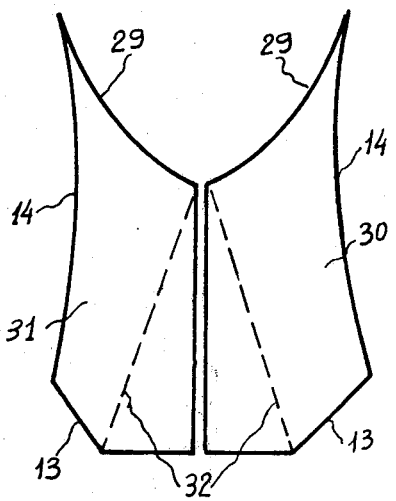

FIG. 5 shows another embodiment, comprising two flat fabric elements, prior to assembly with a view to forming a module.

Figure 6:
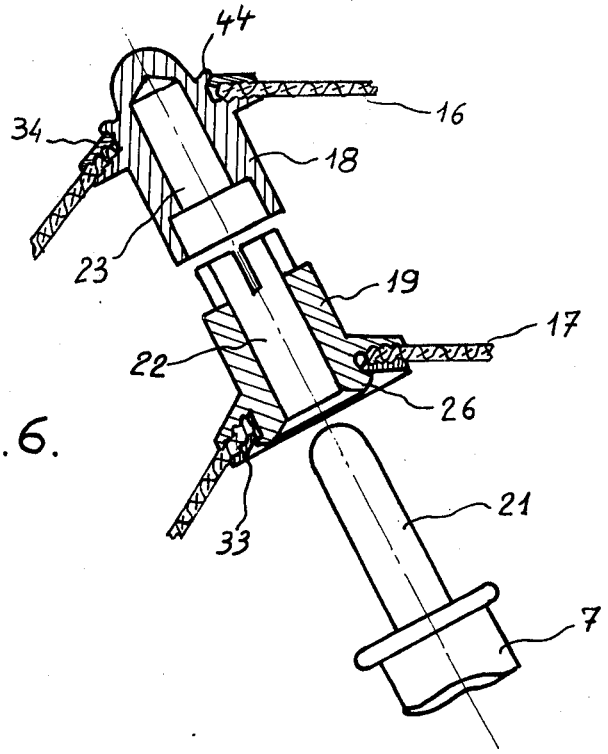

FIG. 6 is a sectional view showing a tent module provided with a double roof and supported by interior masts, said Figure representing, in particular, the connection elements which are adapted to be placed onto the mast.

Figure 7:
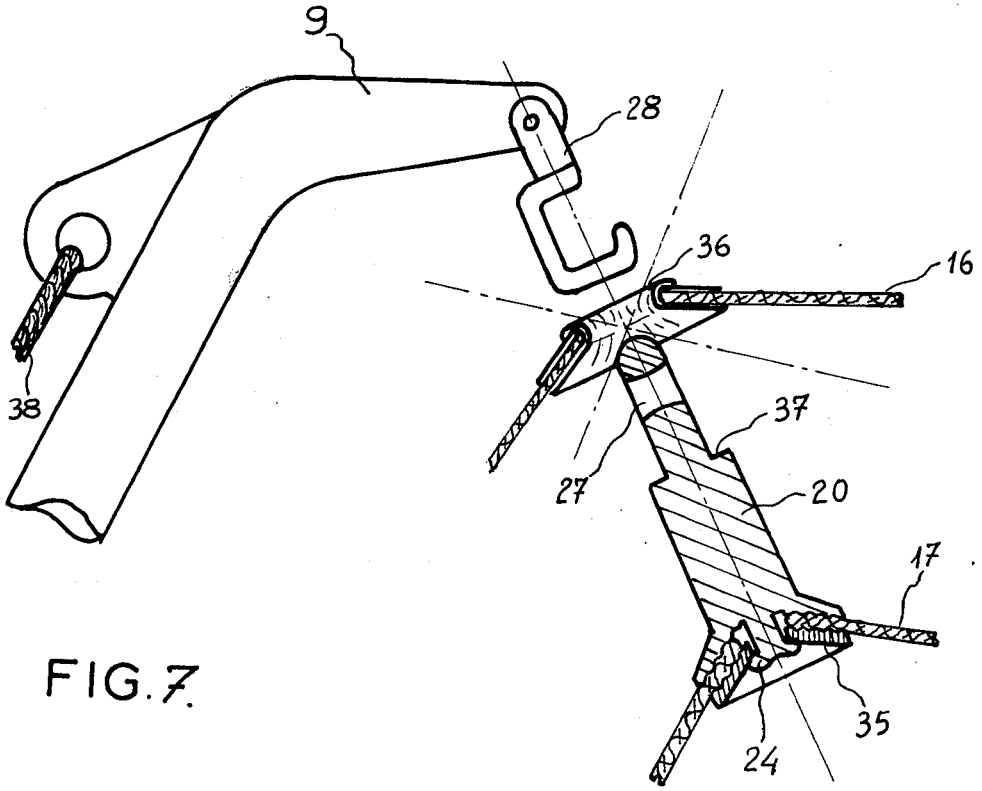

FIG. 7 is a sectional view showing the outer point of a module of a tent comprising a double roof and supported by outer supporting elements, said Figure showing in particular the positioning elements.

Figure 8:
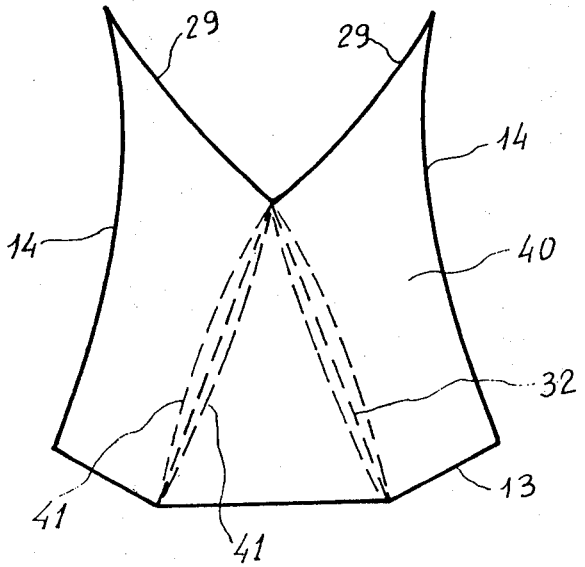

FIG. 8 shows an embodiment wherein each module is constituted by one fabric panel.

Figure 9:
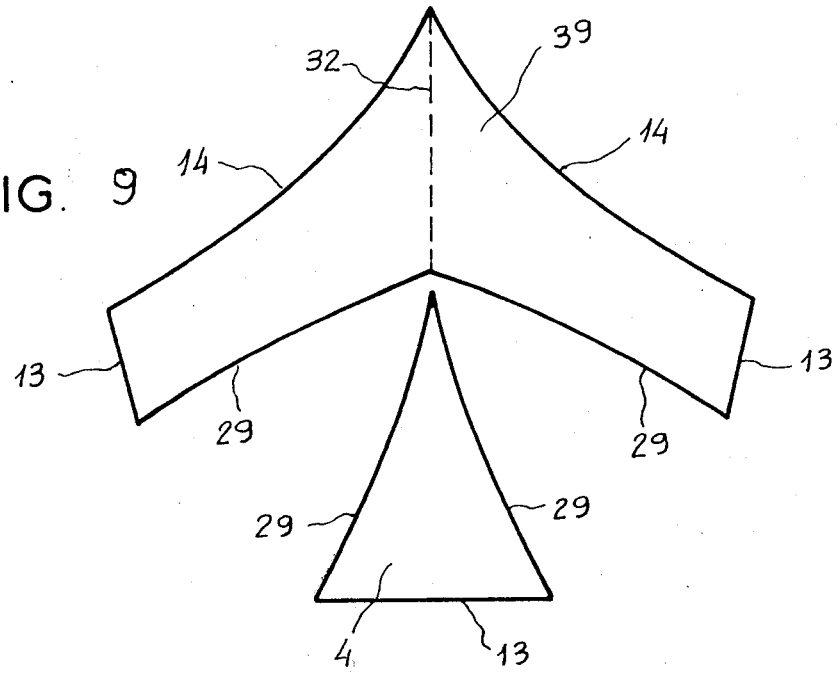

FIG. 9 shows two pre-cut fabric panels adapted to constitute a tent module.

Figure 10:
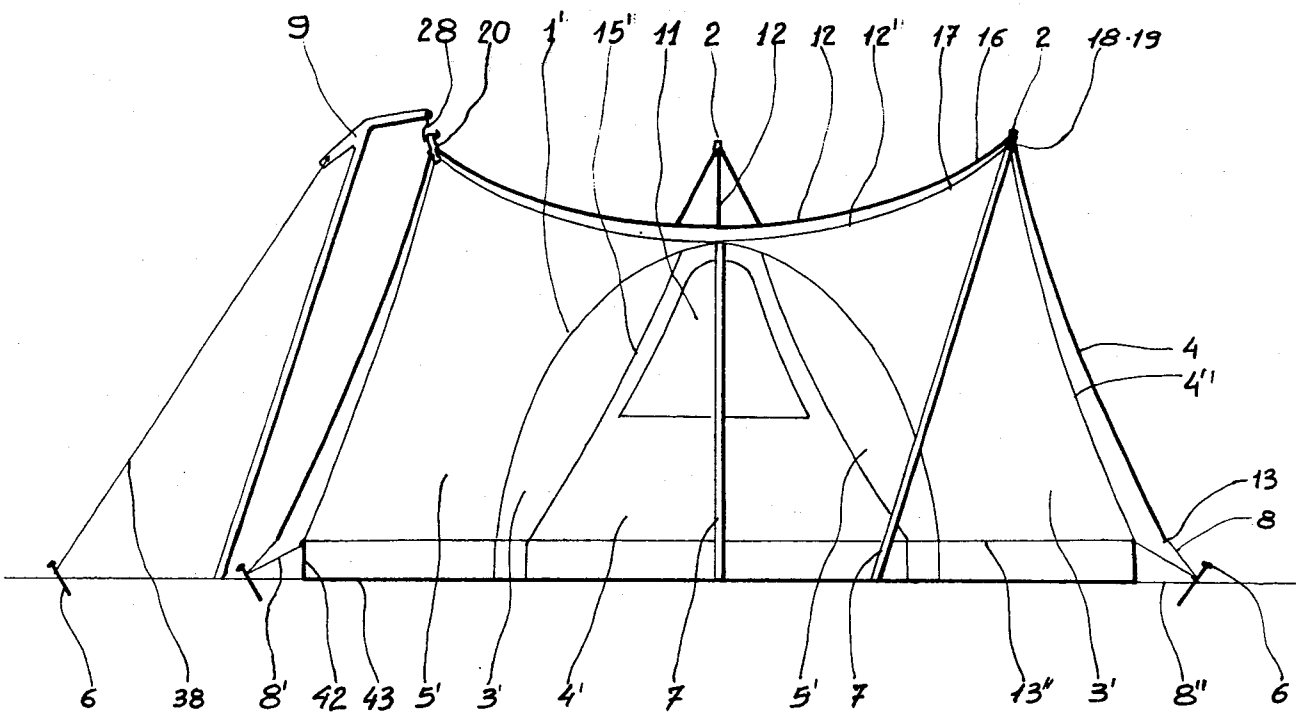

FIG. 10 is a sectional view of a tent according to the invention, comprising a ground carpet.

Figure 1:
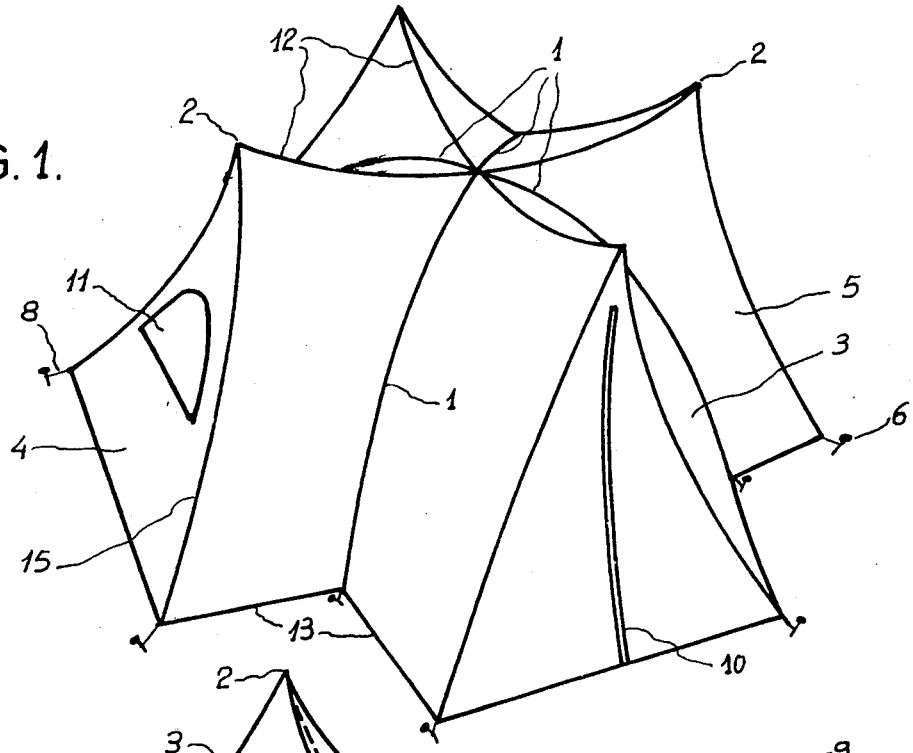
FIG. 1 is a perspective view of a tent according to the invention, comprising four modules.
Figure 2:
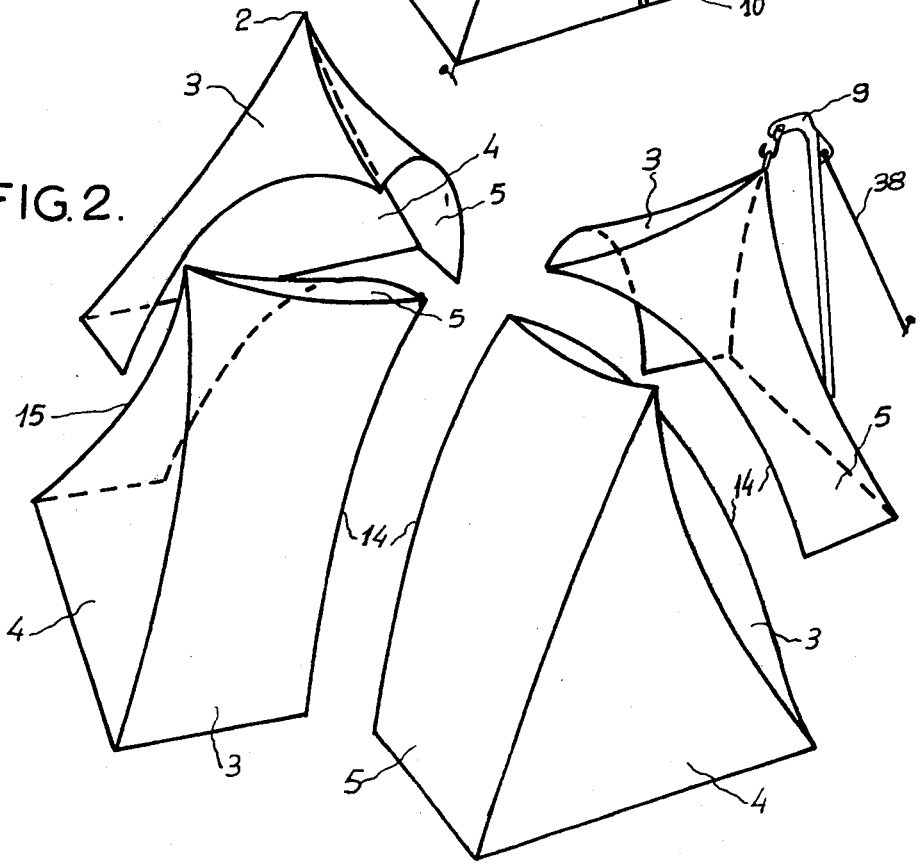
FIG. 2 is an exploded view, in perspective, of the tent according to FIG. 1, comprising four modules.

The tent represented in FIGS. 1 and 2 comprises four modules. Each module comprises a fabric panel 4 named "end wall portion," which has a substantially triangular shape, and two lateral panels, or wall portions 3 and 5, which define a top edge 12 and which are connected to the end wall portion 4 by two rising edges 15 which converge at the top of said end wall portion at a point indicated by reference numeral 2; the above mentioned top edge 12 of the module also intersects said rising edges 15 at point 2.

The two lowermost points of rising edges 15 are anchored by strips or sandows 8 connected to pegs driven into the ground.

As shown, the top edge 12 has a curved concave shape, as seen from the outside of the tent.

Figure 3:
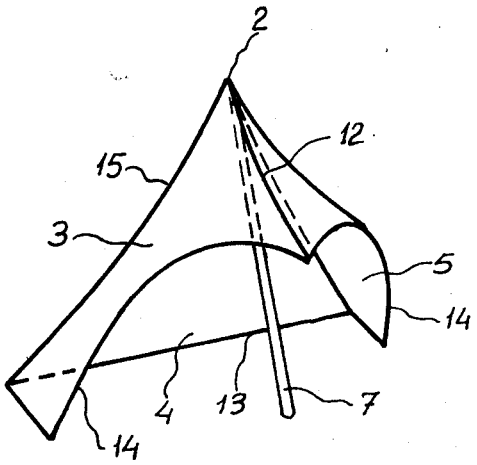
FIG. 3 is a perspective view of a module of the tent, supported by an interiour mast.

As indicated particularly in FIG. 3 the top point 2 defined at the intersection of rising edges 15 and top edge 12 of each module is supported in the present embodiment, by an inclined mast 7 arranged inside of the tent; the shape and arrangement of the fabric elements of the various modules being such that the top edges 12 of said modules constitute, as seen from the outside of the erected tent, concave curves which have a common point of intersection, or center, located on a vertical median axis of the tent.

The rising inner edges 14 (cf. FIGS. 1, 2, 3 and 4) delimiting each one two respective adjacent lateral wall portions of two adjacent modules are cut (or otherwise shaped) in such a manner that they form each a convex curve, as seen from the outside of the erected tent.

At least one of the end wall portions 4 can define a door 10 (FIG. 1), and at least one other end wall portion can comprise a window 11 (FIGS. 1 and 4).

FIG. 5 shows an embodiment wherein each module is constituted by two fabric elements (instead of three, as in the previously described embodiment). In this particular embodiment each element is constituted by a lateral wall portion and one half of the associated end wall portion. This embodiment is particularly advantageous from the economic point of view.

FIG. 6 shows a detail of an embodiment of the tent according to the invention, wherein the top points or apices 2 of the modules are supported by mast 7 arranged inside of the tent. Furthermore, the embodiment shown in FIG. 6 comprises two roofs, to wit: an outer roof 16 and an inner roof 17. Said roofs are attached to mast 7 by two connecting elements 18, 19 adapted to be nested one into the other. Connecting element 19 comprises fixing means 33 adapted to lock and fix the fabric, and it defines the top point 2 of the module. Similarly, the outer roof is attached to conecting element 18 by means of a ring-shaped member 34 retained by a protruding portions 44. The lower connecting element 19 has a bore 22 adapted to receive the head 21 of the associated mast 7. It should be well understood that the presence of the outer roof 16 is not necessary; when no outer roof 16 is provided it is not necessary to provide the lower connecting element 19. In this case, connecting element 28 is mounted directly onto the head 21 of the mast.

The fabric elements are fixed by any convenient means to each one of the associated connecting elements which are mounted onto the head 21 of the associated mast 7. Said fabric elements are maintained in place by a protruding portion or by crimping, as indicated hereinabove, and as shown in the drawing.

FIG. 7 shows a detail of an embodiment wherein the masts 7 inside of the tent are replaced by outer supports 9 which are preferably braced each by a cable 38 anchored in the ground by any convenient means. In this embodiment the tent also comprises two super-imposed roofs 16, 17. The outer roof 16 is attached by crimping to an annular element 36 while the inner roof 17 is attached to an element 20 by means of a ring-shaped member 35 maintained by a cripmed or similar protruding portion indicated at 24 onto a central brooch-like portion of element 20. Said element 20 has an annular exterior shoulder 37 which acts as a positioning stop for the annular element 36, as shown in FIG. 7.

When the annular element 36 is mounted on the shoulder 37, an aperture 27 provided in the upper portion of element 20 can be engaged by a hook 28 attached to the upper end of supporting member 9. When this hook 28 has been introduced into aperture 27 the outer roof 16 is maintained in position so as to be prevented from escaping upwardly, and so as to provide the required distance between the two roofs; supporting member 9 is conveniently maintained in the desired position by cable 38 so as to apply a stretching force to the fabric constituting the associated module of the tent, including the double roof. When no double roof is provided, element 20 may have the same length, which allows for mass production of the tent according to the invention; in this case, the annular element 36 is not associated to shoulder 37.

FIG. 8 shows an embodiment of the tent wherein each module is constituted by a single fabric panel cut to a convenient shape. FIGS. 4 and 5 which show, respectively, embodiments comprising modules constituted by two panels and by three panels, illustrate the shape which should be given to a single panel constituting a module.

FIG. 9 shows two panels as pre-cut with a view to be assembled to form a tent module according to the invention.

FIG. 10 shows an embodiment of a tent with a double roof 4, 4', 12, 12'. In this embodiment the tent is also provided with a ground carpet 43 surrounded by a peripheral wall portion 42. Strips or sandows 8'' connect the ground carpet to the spikes 6, while other strips or sandows 8' connect the upper edge 13' of the peripheral wall portion 42 to said spikes 6, to which are furthermore connected strips or sandows 8 attached to the lower edge of the outer roof 4. On the left side of FIG. 10, this embodiment is provided with an outer supporting member 9 braced by a cable 38 which is fixed to a spike, whereas on the right side of said Figure, the embodiment shown comprises an inner mast 7, the outer support member 9 and the inner mast 7 corresponding to those described herein above. The remaining parts of Figure 10 are self-explanatory with reference to the above description of the other embodiments of the invention. It will be understood that in this Figure the same reference numerals are used as in the preceding Figures for designating identical or similar elements of the tent.

Dotted lines 32 indicate the folding lines, while dotted lines 41 indicate sewing lines forming pleats for defining the outer concave rising edges in the erected tent.

It should be noted that the term "fabric web material" as used in the present specification and appended claims is meant to cover any convenient textile or synthetic material, woven or not.

What is claimed is:

1. A portable tent comprising at least three substantially similar modules made of a flexible web material, each module comprising (i) two generally quadrilateral side wall portions of identical respective shapes and dimensions and (ii) a substantially triangular end wall portion having two rising edges and a lower edge, the side wall portions of each module having a top edge spaced from the ground when the tent is erected, said top edge extending between an outer top end and an inner top end thereof, each side wall portion further having a bottom edge extending between an inner bottom end and an outer bottom end thereof, the bottom edges of each module being parallel and located adjacent the ground when the tent is erected, each side wall portion also having an outer rising edge extending between said outer top end and said outer bottom end thereof, and an inner rising edge extending between said inner top end and said inner bottom end thereof, the respective top edges of the two side wall portions of every module being coextensively and permanently connected to each other to form a common top edge, the outer rising edges of said side wall portions of each module being coextensively and permanently connected to respective rising edges of the associated triangular end wall portion, the inner rising edge of one of the side wall portions of each module being coextensively and permanently connected to an inner rising edge of one side wall portion of an adjacent module and the inner rising edge of the other side wall portion of each said module being coextensively and permanently connected to the inner rising edge of one side wall portion of another adjacent module, the common top edges of all of said modules meeting at the inner top ends thereof to define a symmetrical enclosure, said tent further comprising a plurality of substantially rigid elongated supporting means, each means supporting one of said outer top ends when said tent is erected, a portion of each of said supporting means being adapted to rest on the ground.

2. The tent of claim 1, wherein each module comprises three permanently assembled web material panels forming, respectively, said two side wall portions and said triangular end wall portion thereof.

3. The tent of claim 1, wherein each module comprises two permanently assembled web material panels each of which forms one of the two side wall portions and one half of the triangular end wall portion of the module.

4. The tent of claim 1, wherein each module comprises two permanently assembled web material panels one of which forms the two side wall portions of the module, while the other web material panels forms the triangular end wall portion of said module.

5. The tent of claim 1, wherein each module comprises a single web material panel, a central part of which forms the triangular end wall portion of the module, while the remaining portions of said web material panel form the two side wall portions of said module.

6. The tent of claim 1, wherein said outer rising edges of said side wall portions of each module present a substantially concave configuration, as seen from the outside of the erected tent.

7. The tent of claim 1, wherein said inner rising edges of said side wall portions of each module present a substantially convex configuration, as seen from the outside of the erected tent.

8. The tent of claim 1, wherein the common top edge of said side wall portions of each module presents a substantially concave configuration as seen from the outside of the erected tent.

9. The tent of claim 1, wherein the triangular wall portions of said modules are inwardly inclined, in the erected tent, in such a manner that, as viewed from above, the top ends of said end wall portions are located nearer the center of the tent than the bottom edges of said end wall portions.

10. The tent of claim 1, wherein at least one of the wall portions of at least one said modules is provided with means defining an entry adapted to be opened and closed.

11. The tent of claim 1, wherein at least one of said wall portions of at least one of said modules is provided with means defining a window.

12. The tent of claim 1, wherein said supporting means comprise masts arranged inside said tent, said masts being slightly inclined so as to converge toward the ground.

13. The tent of claim 12, wherein a connecting element is provided at each one of the respective outer ends of the top edges of said side wall portions of said modules, and means for coupling each of said connecting elements to the upper end portion of an associated one of said masts arranged inside of said tent.

14. The tent of claim 1, wherein said supporting means are disposed outside of said tent.

15. The tent of claim 14, wherein each one of the respective outer ends of said top edges of the side wall portions of said modules is provided with a connecting element adapted to be attached to a complementary connecting element associated with a corresponding one of said means disposed outside of said tent.

16. The tent of claim 14, wherein said supporting means disposed outside of said tent are provided with bracing means.

17. The tent of claim 1, comprising supplementary wall portions substantially coextensive with respect to and spaced from, said side and end wall portions of said modules so as to form a second roof-like layer of said tent, said supplementary wall portions being spaced from said side wall portions and end wall portions by spacing means defining a desired isolating space between said supplementary wall portions and said side and end wall portions.

18. The tent of claim 17, wherein each module is provided with an aperture in register with a corresponding aperture provided in said second roof-like layer comprising said supplementary wall portions, the respective peripheries of any two of said registering apertures being fixed respectively to two connecting elements one of which is adapted to be mounted onto the upper end of an associated supporting member and to be telescopically mounted to the associated other connecting element.

19. The tent of claim 17, wherein each module is provided at the common top edge of the permanently connected side wall portions thereof with a first connecting element, the periphery of an aperture provided in said second roof-like layer in alignment with said first connecting element being fixed to a second connecting element, said first and second connecting elements being adapted to be mounted telescopically onto each other, and one of said connecting elements being provided with means for fixing the same to an associated one of said supporting members.

20. The tent of claim 1, comprising a web material portion permanently connected to the bottom edges of said wall portions of said modules so as to form a carpet adapted to repose on the ground inside of the erected tent.

21. The tent of claim 20, wherein said carpet is provided with a peripheral upwardly extending wall portion connecting said carpet to the bottom ends of the wall portions of said modules.

* * * * *